US005857469A

United States Patent [19]

Sowell

[11] Patent Number: 5,857,469

[45] Date of Patent: Jan. 12, 1999

[54] BARRETTE WITH SYSTEM OF MODULARIZED ORNAMENTAL APPENDAGES

[76] Inventor: Wanda Gail Sowell, Rte. 3 Box 316B, Coldwater, Miss. 38618

[21] Appl. No.: 567,415

[22] Filed: Dec. 5, 1995

[51] Int. Cl.[6] ..... A45D 8/12

[52] U.S. Cl. ..... 132/275; 132/276; 132/278

[58] Field of Search ..... 132/273, 275, 132/276, 277, 278, 279; 24/457, 458, 461

[56] References Cited

U.S. PATENT DOCUMENTS

| | | | |
|---|---|---|---|
| D. 280,942 | 10/1985 | Topalian | D28/42 |
| D. 318,540 | 7/1991 | Carter | D28/42 |
| 985,110 | 2/1911 | Butler | 132/279 |
| 3,590,830 | 7/1971 | Hannum | 132/48 R |
| 3,881,501 | 5/1975 | Kleine | 132/48 R |
| 4,753,252 | 6/1988 | Boxer | 132/279 |
| 4,896,685 | 1/1990 | Lawrence | 132/278 |
| 4,912,944 | 4/1990 | Crosley et al. | 132/275 |
| 4,998,186 | 3/1991 | Cocca | 132/275 |
| 5,817,260 | 6/1974 | Kleine | 132/48 |

FOREIGN PATENT DOCUMENTS

| | | | |
|---|---|---|---|
| 2672192 | 8/1992 | France | 132/276 |

*Primary Examiner*—Gene Mancene
*Assistant Examiner*—Pedro Philogene
*Attorney, Agent, or Firm*—John Gugliotta; David L. Volk

[57] ABSTRACT

A clasp is affixed to the underside of a barrette body. The barette body supports a reusable adhesive tape on its upper surface. At least one ornamental appendage includes a smooth surface attractive to the adhesive tape, wherein the ornamental appendage is releasably connectable to the barrette body.

2 Claims, 2 Drawing Sheets

BARRETTE WITH SYSTEM OF MODULARIZED ORNAMENTAL APPENDAGES

BACKGROUND OF THE INVENTION

1. Field of the Invention

The present invention relates generally to barrettes for holding a tress of hair, and, more particularly, to a barrette in combination with a system of modularized, interchangeable ornamental appendages for affixment thereto.

2. Description of the Related Art

As is well-known in the art, barrettes for holding a tress of hair are widely known and currently in general usage. However, in general such barrettes have been limited in appearance to having only one decorative fixture attached to the outer, noticeable side of the barrette. Examples of such barrettes with fixed ornamentation are included in U.S. Pat. No. 3,590,830, issued in the name of Hannum, Design U.S. Pat. No. 318,540, issued in the name of Carter, and Design U.S. Pat. No. 280,942, issued in the name of Topalian.

The problem of requiring a barrette clasp mechanisms for each and every ornamental fixture was addressed in U.S. Pat. No. 3,817,260 and U.S. Pat. No. 3,881,501, both issued in the name of Kleine. As disclosed in the Kleine references, a barrette is provided including a supporting element upon which a variety of differing ornamental broaches can be attached in an attempt to provide a variety of ornamentation.

Consequently, a need has been felt for providing a system of modularized ornamental appendages for use with a standard hair barrette in order to provide an effective, convenient, and efficient method of interchangeable hair decorations.

SUMMARY OF THE INVENTION

It is therefore an object of the present invention to provide an improved hair barrette.

It is another object of the present invention to provide an improved hair barrette with a system of modularized ornamental appendages providing aesthetic variety.

It is yet another object of the present invention to provide an improved hair barrette with a system of modularized ornamental appendages allowing a user to change an ornamental appendage with the barrette still in place, thereby eliminating the need to re-style one's hair.

It is a final object of the present invention to provide an improved hair barrette with a system of modularized ornamental appendages which allow the user to replace a lost or broken clasping mechanism without sacrificing any particular ornamental appendage in the process.

It is a feature of the present invention to provide a barrette of essentially conventional function and construction, but including a modularized, repeatable affixment means for engaging with a variety of ornamental appendages.

Briefly described according to one embodiment of the present invention, a barrette is provided having a clasp element which may be of any suitable or well known type affixed to the underside of a elongated, flat barrette top. The barrette top, having a smooth, flat upper surface, supports a reusable affixment means receiving end, such as a strip of hook and loop fastener material. A plurality of ornamental appendages of many standard or novel types can be provided having affixed a reusable affixment means engaging end, such as an interlocking strip of hook and loop fastener material.

An advantage of the present invention is that an improved hair barrette with a system of modularized ornamental appendages provides aesthetic variety.

Another advantage of the present invention is that it provides an improved hair barrette with a system of modularized ornamental appendages allowing a user to change an ornamental appendage with the barrette still in place, thereby eliminating the need to re-style one's hair.

Yet another advantage of the present invention is that the improved hair barrette with a system of modularized ornamental appendages allows the user to replace a lost or broken clasping mechanism without sacrificing any particular ornamental appendage in the process.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
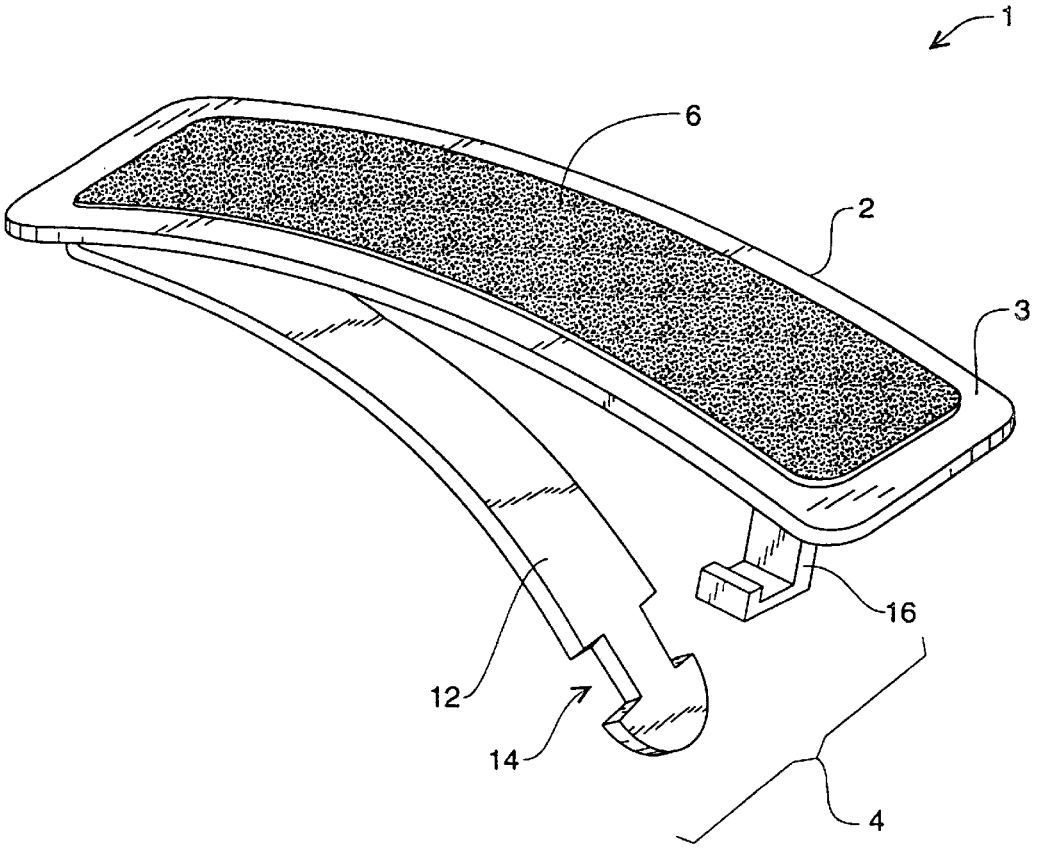
FIG. 1 is a perspective view of barrette for use with the preferred embodiment of the present invention.
Figure 2:
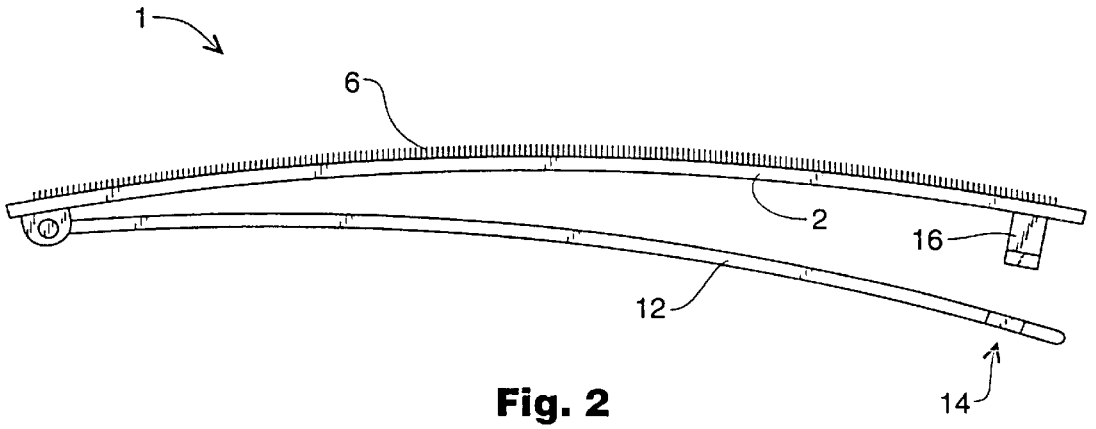
FIG. 2 is a side elevational view thereof.
Figure 3:
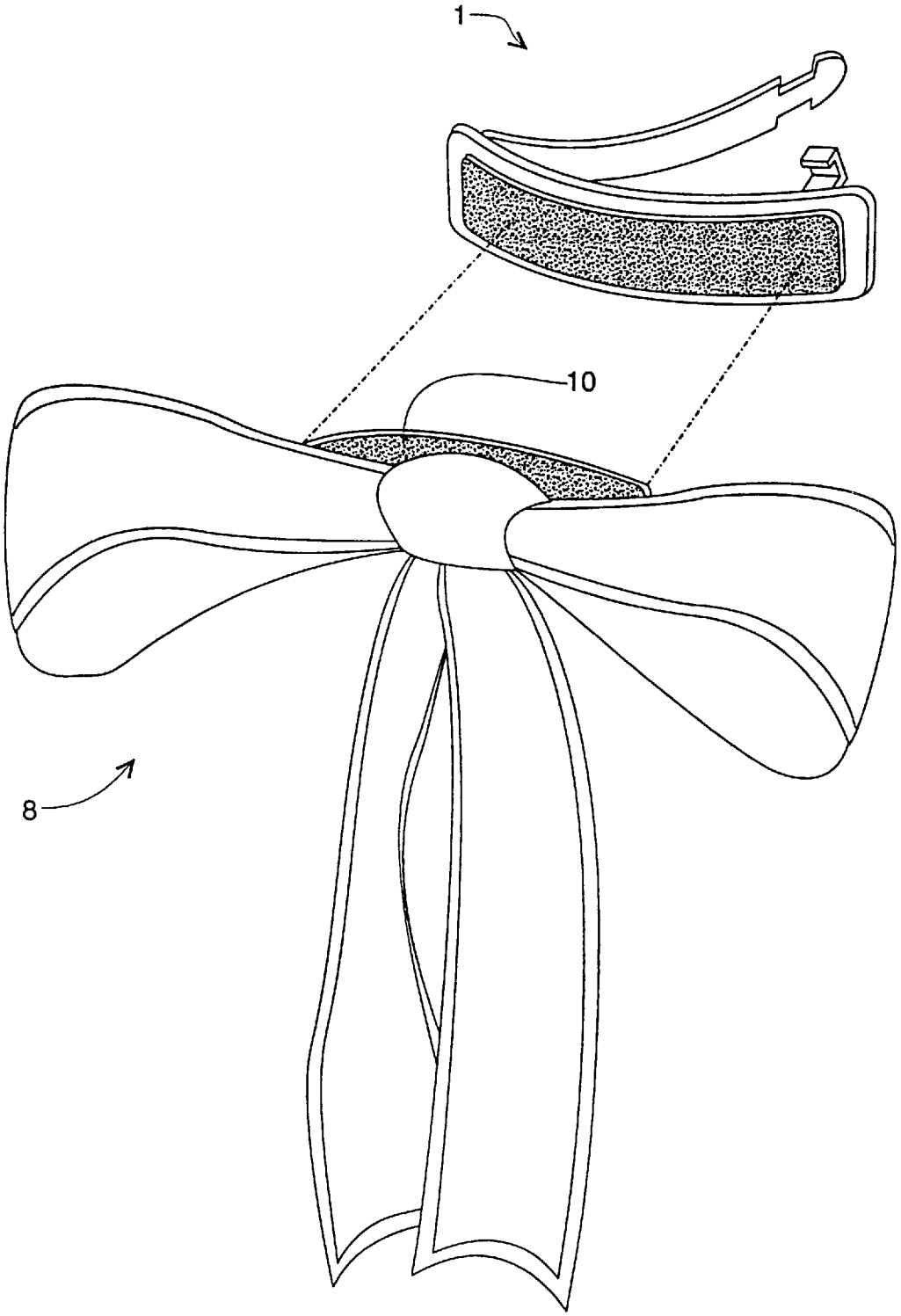
FIG. 3 is a perspective view thereof shown in use with an ornamental appendage.

Referring now to the figures, a barrette 1 is provided, according to the present invention, having a barrette body 2 having an elongated, flat barrette top 3, and a clasp element 4, which may be of any suitable or well known type affixed to the underside of the barrette body 2. The barrette top 3, having a smooth, flat upper surface, supports a reusable affixment means receiving end 6, such as a strip of hook and loop fastener material or re-useable adhesive tape. A plurality of ornamental appendages 8, of many standard or novel types such as bows, ribbons, broaches, and the like, can be provided having affixed a reusable affixment means engaging end 10, such as an interlocking strip of hook and loop fastener material or a smooth, flattened surface attractive to adhesive tape.

Many traditional and available types of clasp elements 4 can be adapted for use with the present invention. This allows a user to include the size, type, and style of barrette into the present system which the user find to be most agreeable with the particular hair type and style that will be in effect. For simplicity of disclosure, the preferred embodiment of the clasp element 4 includes an elongated arcuate arm 12 pivotally affixed to the barrette body 2 at one end such as to remain pivotal in a direction away from the barrette body 2, thereby allowing a tress of hair to be clamped within. The elongated arcuate am 12 forms a spring clip having a keyed end portion 14 for engaging with a latch hook 16, held on the underside of the barrette top 3.

2. Operation of the Preferred Embodiment

In operation, the present invention is utilized initially as with any standard or conventional barrette. The user simply incorporates the barrette into the hair and hairstyle in accordance with personal preferences. Once incorporated into the hair, the user is now presented with a variety of ornamental appendages 8 from which to choose. By simple presenting the reusable affixment means engaging end 10 located on the ornamental appendage 8 to the reusable affixment means receiving end 6 located on the barrette body 2, the user can add, remove, or change ornamentation without any further readjustment of the hair, the clasping element 4, or the barrette body 2.

The foregoing description of the preferred embodiment of the present invention has been presented for purposes of illustration and description. It is not intended to be exhaustive or to limit the present invention to the precise form disclosed, and obviously many modifications and variations are possible in light of the above teachings. Although many modification are currently envisioned, such as variations in either the reusable affixment means or the clasp element, the preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A barrette for engagement with a tress of hair, said barrette comprising:

a barrette body having an underside and an upper surface having reusable adhesive tape affixed thereon;

a clasp element affixed to said underside of said barrette body for engagement with a tress of hair;

at least one ornamental appendage having a smooth surface attractive to said adhesive tape, wherein said ornamental appendage is removably connectable to said upper surface of said barrette body by mating said adhesive tape to said smooth surface.

2. The barrette as described in claim 1, wherein said clasp element comprises:

an elongated arcuate arm pivotally affixed to said underside of said barrette to remain pivotal in a direction away from the barrette body, said arm forming a spring clip having a keyed end portion; and a latch hook affixed to the underside of said barrette in and aligned manner with said keyed end portion of said spring clip for engagement with said spring clip about a held tress of hair.

* * * * *